US007319222B2

(12) United States Patent
Hashimoto et al.

(10) Patent No.: US 7,319,222 B2
(45) Date of Patent: Jan. 15, 2008

(54) MASS SPECTROMETER AND MASS ANALYSIS METHOD

(75) Inventors: Yuichiro Hashimoto, Tachikawa (JP); Hideki Hasegawa, Tachikawa (JP); Izumi Waki, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 242 days.

(21) Appl. No.: 11/325,444

(22) Filed: Jan. 5, 2006

(65) Prior Publication Data

US 2006/0219896 A1 Oct. 5, 2006

(30) Foreign Application Priority Data

Mar. 18, 2005 (JP) ..... 2005-078367
Aug. 1, 2005 (JP) ..... 2005-222327

(51) Int. Cl.
*H01J 49/00* (2006.01)

(52) U.S. Cl. ..... 250/292; 250/282; 250/288; 250/281; 95/27; 95/28; 96/1; 96/2; 96/3; 96/15; 96/49; 96/54; 96/71

(58) Field of Classification Search ..... 250/282, 250/292, 288, 281; 95/27, 28; 96/1, 2, 3, 96/15, 49, 54, 71
See application file for complete search history.

(56) References Cited

U.S. PATENT DOCUMENTS 5,420,425 A 5/1995 Bier et al.
5,783,824 A 7/1998 Baba et al.
5,905,258 A 5/1999 Clemmer et al.
6,177,668 B1 1/2001 Hager
2002/0175279 A1* 11/2002 Hager ..... 250/282

* cited by examiner

*Primary Examiner*—Robert Kim
*Assistant Examiner*—Michael Maskell
(74) *Attorney, Agent, or Firm*—Reed Smith LLP; Stanley P. Fisher, Esq.; Juan Carlos A. Marquez, Esq.

(57) ABSTRACT

A linear trap which allows for charge separation and ion mobility separation in a speedy manner, and enables measurement with high duty cycle. A mass spectrometer comprises an ion source, an ion trap for trapping ions ionized by the ion source, an ion trap controller for controlling a voltage on an electrode included in the ion trap, and a detector for detecting the ions ejected from the ion trap. The ion trap controller includes a table for each mass-to-charge ratio, the table containing a frequency of the voltage used for charge separation, and a gain of the voltage for ejecting a first ion with a first charge outside the ion trap, and retaining in the ion trap a second group of ions with a second charge that is lower than that of the first charge. The ion trap controller controls the voltage based on the mass-to-charge ratio set. The mass spectrometer has significantly improved sensitivity, as compared to the prior art.

14 Claims, 10 Drawing Sheets

MASS SPECTROMETER AND MASS ANALYSIS METHOD

CLAIM OF PRIORITY

The present application claims priority from Japanese applications JP 2005-078367 filed on Mar. 18, 2005, and JP 2005-222327 filed on Aug. 1, 2005, the contents of which are hereby incorporated by reference into this application.

FIELD OF THE INVENTION

The present invention relates to mass spectrometers.

BACKGROUND OF THE INVENTION

In mass spectrometers used for proteome analysis or the like, separation of multiple charge ions is very important. In electrospray ionization, most of noise ions are singly charged, whereas peptide ions tend to be multiply charged. Accordingly, technologies are very important for effective separation of only multiple charge ions from singly charged ions. Information on the charge number is obtained by analyzing mass spectra provided as a result of measurements with high resolution and less spectrum duplication. A sample previously subjected to a simple pretreatment, however, contains multiple components, and spectra thereof are superimposed on one another. This makes it difficult to identify the multiple charge ions and the singly charged ions by means of software. To approach the above-mentioned problem, the U.S. Pat. No. 2002/0175279 discloses a method for achieving charge separation by means of hardware. In the method disclosed, collision of gas molecules inside a linear trap allows ions to be cooled to the thermal temperature. Then, potential on one or both sides of an end lends in the linear trap is decreased to be a potential D of 0.1 to 1 V with respect to an offset potential of a linear trap section. At this time, a trap potential of the singly charged ions is the potential D, while a potential of n-charged ions is a potential nD. In contrast, kinetic energy of ions is maintained to be approximately thermal temperature energy (kT) regardless of the charge under cooling of the ions. Since the ion energy has a Maxwell-Bolzmann distribution, ions are ejected outside the trap in order from low to high charge, wherein the lower charged ions form a lower potential than the multiple charge ions. After this processing, mass spectrometry is carried out in the linear trap. Alternatively, ions may be introduced into a time-of-flight mass spectrometer so as to perform the mass spectrometry. During this time, a collision gas chamber or the like may be provided to perform MS/MS analysis or the like, as disclosed in the above document.

In the linear trap, separation of ions based on the mass-to-charge ratio (m/n, m: mass, n: charge number) has hitherto been carried out using a supplemental AC voltage, as disclosed in, for example, the U.S. Pat. No. 5,420,425. According to this document, a harmonic potential is formed radially by a RF voltage. A supplemental AC voltage which resonates with the harmonic potential is applied to between electrodes opposed to each other to radially eject the ions with the specific mass-to-charge ratio.

Another method for ion separation based on the mass-to-charge ratio in the linear trap is disclosed in the U.S. Pat. No. 6,177,668. According to this document, a harmonic potential is formed radially by a RF voltage. A supplemental AC voltage which resonates with the harmonic potential is applied to between electrodes opposed to each other, or between quadrupole rods and end lenses to axially eject the ions with the specific mass-to-charge ratio.

A further method for ion separation based on the mass-to-charge ratio (m/n) in the linear trap is disclosed in the U.S. Pat. No. 5,783,824. Wing electrodes are inserted into between multipole rods to form a harmonic potential on an axis. A supplemental AC voltage which resonates with the harmonic potential is applied to between the wing electrodes to axially eject the ions with the specific mass-to-charge ratio.

Ion mobility separation in the mass spectrometry is disclosed in the U.S. Pat. No. 5,905,258. Ions ejected pulsely from an ion source or an ion trap are subjected to a constant DC electric field under gas pressure of approximately 10 mTorr. Since the velocities of ions accelerated by the electric field are different from each other, separation of the ion mobility is performed in an acceleration area of the DC electric field. Timings at which the ions reach a mass spectrometry section are different due to the ion mobility thereof, which can facilitate the separation.

SUMMARY OF THE INVENTION

The challenge to charge separation by means of hardware is to achieve speed-up. In a linear trap, during the charge separation, other measurement sequences are suspended, disadvantageously leading to a decrease in usability of ions, namely, sensitivity in the whole device. In the charge separation as disclosed in the U.S. Pat. No. 2002/0175279, a potential barrier on the axis needs to be lowered so as to achieve the speedy separation. However, as the potential on the axis is decreased, the charge selectivity or separation is also degraded due to an influence from a fringing field. That is, in the technology as disclosed in the U.S. Pat. No. 2002/0175279, the selectivity and sensitivity of ions are not compatible with each other. To obtain the sufficient charge separation, a relatively long separation time interval, for example, several hundreds ms, is necessary. Taking as an example a charge separation trap involving three stages, namely, ion accumulation, charge separation, and ejection, the usability of ions is calculated in the following manner. In general, ions are introduced from an ion source to the charge separation trap at a constant rate. In this case, the usability of ions is calculated by the following formula (1):

$$\text{Duty_Cycle} = \frac{T_A}{T_A + T_S + T_E}$$

where $T_A$ is an accumulation time of ions, $T_S$ is a time for charge separation, and $T_E$ is a time for ejection.

Typically, the accumulation time is about 10 ms, the charge separation time is about 100 ms, and the ejection time is about 5 ms. From these values, the usability of ions is determined to be 8%. Such loss of duty cycle leads to significant decrease in sensitivity of the whole device.

In contrast, in the U.S. Pat. Nos. 5,420,425, 6,177,668, and 5,783,824, only the separation based on the mass-to-charge ratio is explained, but the charge separation is not described at all.

It is an object of the invention to provide a method of high-speed charge separation using a linear trap. As can be seen from the above-mentioned formula (1), the shorter the charge separation time is, the higher the duty cycle of ions, and thus the sensitivity is improved.

It is another object of the invention to provide a mass spectrometer with a simple structure and high sensitivity. It should be noted that in the method as disclosed in the U.S. Pat. No. 5,905,258, a system for speedy data processing is needed, resulting in high costs, and ions diffuse during mobility separation of several tens ms, resulting in significantly decreased sensitivity.

In one aspect, the present invention is directed to a mass spectrometer comprising an ion source, and an ion trap for trapping ions ionized by the ion source. The mass spectrometer also includes an ion trap controller for controlling a voltage on an electrode included in the ion trap, and a detector for detecting ions ejected from the ion trap. The ion trap controller includes a table for each mass-to-charge ratio. The table contains a frequency of the voltage used for charge separation, and a gain of the voltage for ejecting a first ion with a first charge outside the ion trap, and retaining in the ion trap a second group of ions with a second charge that is lower than the first charge. The ion trap controller controls the voltage based on the mass-to-charge ratio set.

In another aspect, the present invention is directed to a mass analysis method comprising the steps of ionizing a sample, and introducing ions ionized into an ion trap. The method also includes the step of applying a voltage to an electrode included in the ion trap, the voltage having a frequency based on a mass-to-charge ratio set, and a gain for the set mass-to-charge ratio for ejecting a first ion with a first charge outside the ion trap, while retaining in the ion trap a second ion with a second charge that is lower than the first charge. Further, the method includes the step of detecting the first ion ejected.

In another aspect, the present invention is directed to a mass spectrometer comprising an ion source, and an ion trap for trapping ions ionized by the ion source. The mass spectrometer also includes an ion trap controller for controlling a voltage on an electrode included in the ion trap, and a detector for detecting ions ejected from the ion trap. The ion trap controller includes a table for each mass-to-charge ratio. The table contains a frequency of the voltage used for ion mobility separation, and a gain of the voltage for ejecting a first group of ions with first ion mobility outside the ion trap, and retaining in the ion trap a second group of ions with second ion mobility that is lower than the first ion mobility. The ion trap controller controls the gain or the frequency of the voltage based on the mass-to-charge ratio set.

In another aspect, the present invention is directed to a mass analysis method comprising the steps of ionizing a sample, and introducing the ions ionized into an ion trap. The method also includes the step of applying a voltage to an electrode included in the ion trap, for ejecting a first ion with first ion mobility outside the ion trap, while retaining in the ion trap a second ion with second ion mobility that is lower than the first ion mobility. The method further includes the step of detecting the first ion ejected.

The invention can provide apparatus and method for analyzing ions with high sensitivity in a speedy manner using a linear trap for selectively allowing passage of multiple charge ions. Further, the invention can provide apparatus and method for enabling effective separation of ion mobility.

DETAILED DESCRIPTION OF THE PREFERRED EMBODIMENTS

First Embodiment

Figure 1:
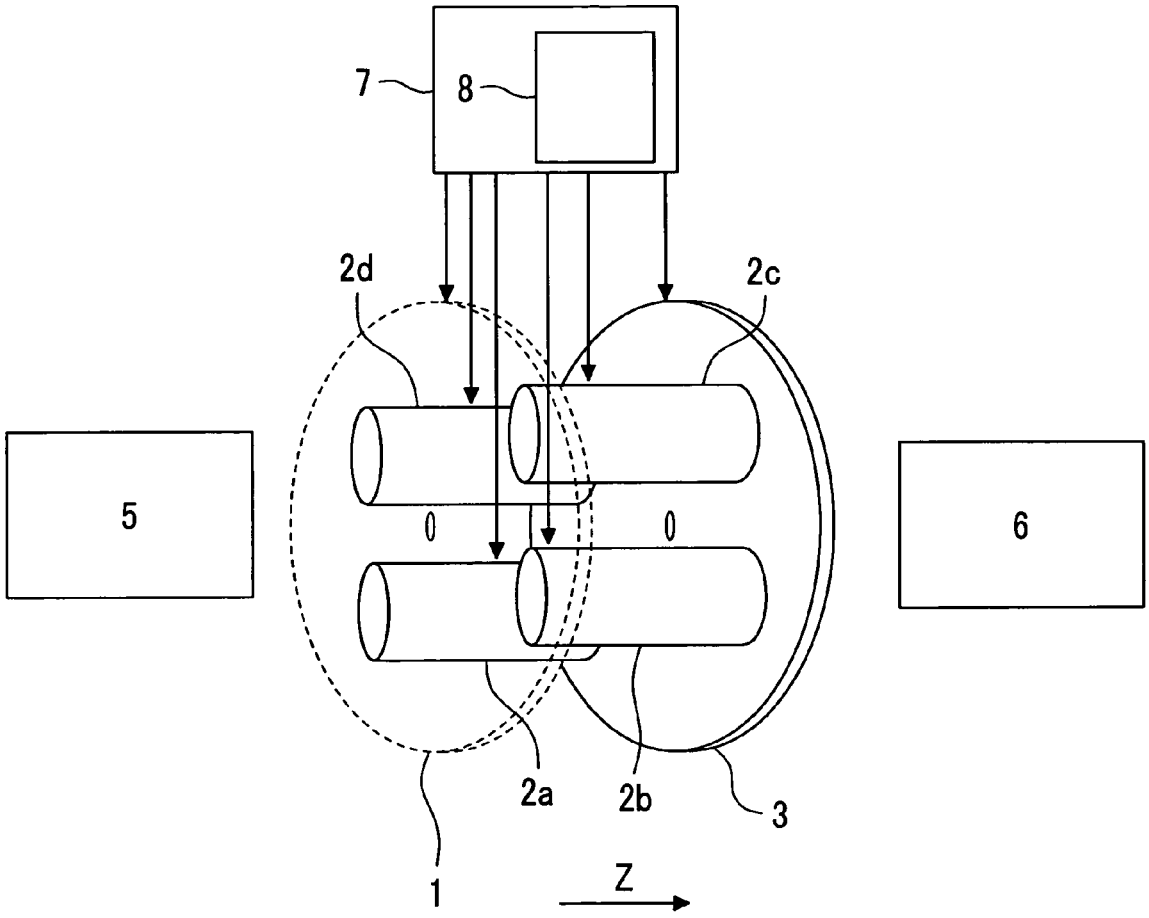
FIG. 1 is a diagram showing a mass spectrometer according to a first preferred embodiment of the invention.

FIG. 1 is a diagram of a configuration of a mass spectrometer using a linear trap section enabling charge separation according to a first preferred embodiment of the invention. Ions are generated by an ion source 5, such as an electrospray ion source, or a Matrix Assisted Lasor Desorption Ionization ion source. The ions generated are introduced via a differential pumping region, and an ion guide, which are not shown, into a linear trap comprising four rods 2, and end lenses 1 and 3 on both sides thereof. Application of a voltage to the linear trap is performed by a power supply 7 for a controller. Typically, the length of the rod 2 is set to 7.0 mm, the diameter of a pole to 7.0 mm, a distance between the poles to 7.0 mm, and a distance between the rod 2 and the end lenses 1, 3 to about 10 mm. Trap RF voltages (frequency: 500 to 3 MHz (typically, 1 MHz), and amplitude: 100 V to 5 kV) are applied to the rods 2 such that the adjacent rods are subjected to the voltages in opposite phase. That is, the rods 2*a* and 2*c* (also, the rods 2*b* and 2*d*) are subjected to the voltages in the same phase. A voltage of about 1 to 5 V is applied to the end lens respective to the offset potential of the rod. In the known linear trap, the ratio of the length of the pole to the distance between the poles (namely, pole length/distance between the poles) is set to about 5 to 100. In the present invention, however, the ratio is set to a value equal to or less than three 3. This causes the DC electric field of the end lenses 1 and 3 to penetrate inside, thereby enabling formation of a harmonic potential on an axis. The application of the DC voltage forms a harmonic potential in the Z axial direction in a space enclosed with the rods 2 and the end lenses 1 and 3.

Figure 2:
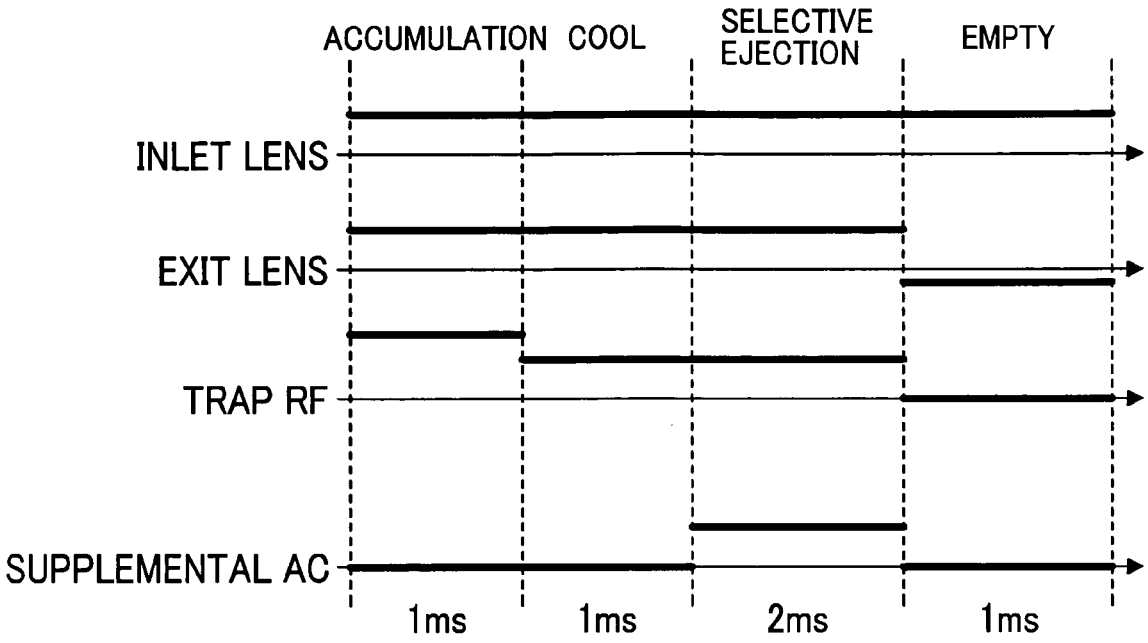
FIG. 2 is a diagram showing a measurement sequence in the first embodiment.

Reference will now be made to a mechanism for exciting an orbit amplitude of ions with a specific mass-to-charge ratio under the harmonic potential and ejecting the ions outside the trap. FIG. 2 illustrates a measurement sequence which comprises four steps, namely, accumulation, cooling, separation and ejection, and empty. In accumulation of ions, ions generated from the ion source are introduced into an ion trap. The use of a differential pumping region which has been developed recently and has improved efficiency of ion introduction can typically limit the time for accumulation of ions to 10 ms or less so as to restrict a space charge effect.

Note that the accumulation time depends on the structure of the ion source and the differential pumping region. The voltages of the end lenses 1 and 3 are set to a value higher by several V to several tens V than an offset potential of the rod 2, thereby trapping the ions into the linear trap. Then, the ions are cooled to the thermal temperature. Thereafter, the separation and ejection of the ions is performed. More specifically, only the ions with the specific mass-to-charge ratio resonate and oscillate according to the following formula, as explained below, and then are ejected outside the trap. A potential in the axial direction at a distance of z from a minimum point of the harmonic potential in the Z direction is closely analogous to the following formula (2):

$$D(z) \approx D_0\left(\frac{z}{a}\right)^2$$

wherein $D_0$ is a harmonic potential in separation and ejection, and a is a distance between an end of the harmonic potential and the minimum point thereof.

The supplemental AC voltages in opposite phase are applied to the end lenses 1 and 3, respectively. The AC voltage applied typically has a voltage amplitude of 0.5 to 5 V, and a single frequency of about 1 to 100 kHz, or comprises the voltages superimposed on one another (maximum amplification of about 2 to 50 V). Now, selection of the frequency will be described in detail. An equation of motion in the Z direction is represented by the following formula (3):

$$m\frac{d^2z}{dt^2} = -2neD_0\frac{z}{a^2}$$

where m is a molecular weight, e is an electron charge, and n is a charge number. From the above-mentioned formula, a resonance frequency f in the Z direction is represented by the following formula (4):

$$f = \frac{1}{2\pi}\sqrt{\frac{2enD}{ma^2}}$$

When D=5 V, and a=5 mm, the resonance frequency f is represented by the following formula (5):

$$f = 9.8\times10^5\times\frac{1}{\sqrt{M}}\,\text{Hz}$$

where M is a mass-to-charge ratio (in units of Th). The resonance frequency f in the Z direction is decreased in inverse proportion to the square root of the mass-to-charge ratio. Ions within a specific range of mass-to-charge ratios are axially resonated and excited by application of the supplemental AC voltage. The ions with a large orbit amplitude and exceeding the harmonic potential of the end lens 1 or 3 are ejected outside the trap section. In contrast, ions with the mass-to-charge ratios which have no influence from the resonance continue to be accumulated in the center of the trap. By setting the DC potential on an inlet end lens 1 higher by about several V than that on an outlet end lens 3, about 100% of the ions are ejected from the outer end lens 3 to a mass spectrometry section 6, such as an ion trap, a linear trap, a TOF, or a Fourier transform type ion-cyclotron mass spectrometry section. The mass spectrometry section can detect the ions with the specific mass-to-charge ratio selectively ejected from the linear trap. The well-known mass spectrometry section may detect the ions after collision and dissociation of the ions. Last, the ions are emptied from the trap. Particularly, by changing the RF voltage to zero, the ions are emptied radially. This step is repeated to cause ions of the specific mass-to-charge ratio to be introduced selectively into the mass spectrometry section 6, which is located in a later stage. The mechanism for ejecting the ions with the specific range of mass-to-charge ratios outside the trap has been described.

Reference will now be made in detail to a method and principle for separation of ions with a charge number n using the linear trap described above. A measurement sequence in charge separation is the same as that shown in FIG. 2, and comprises four steps, namely, accumulation, cooling, separation and ejection, and empty. The known data on a collision cross section σ ($nm^2$) measured by the conventional ion mobility spectrometer or the like is closely analogous to the following formula (6) respective to a molecule weight m (in units of Da):

$$\sigma=0.23m^{0.42}$$

Figure 3:
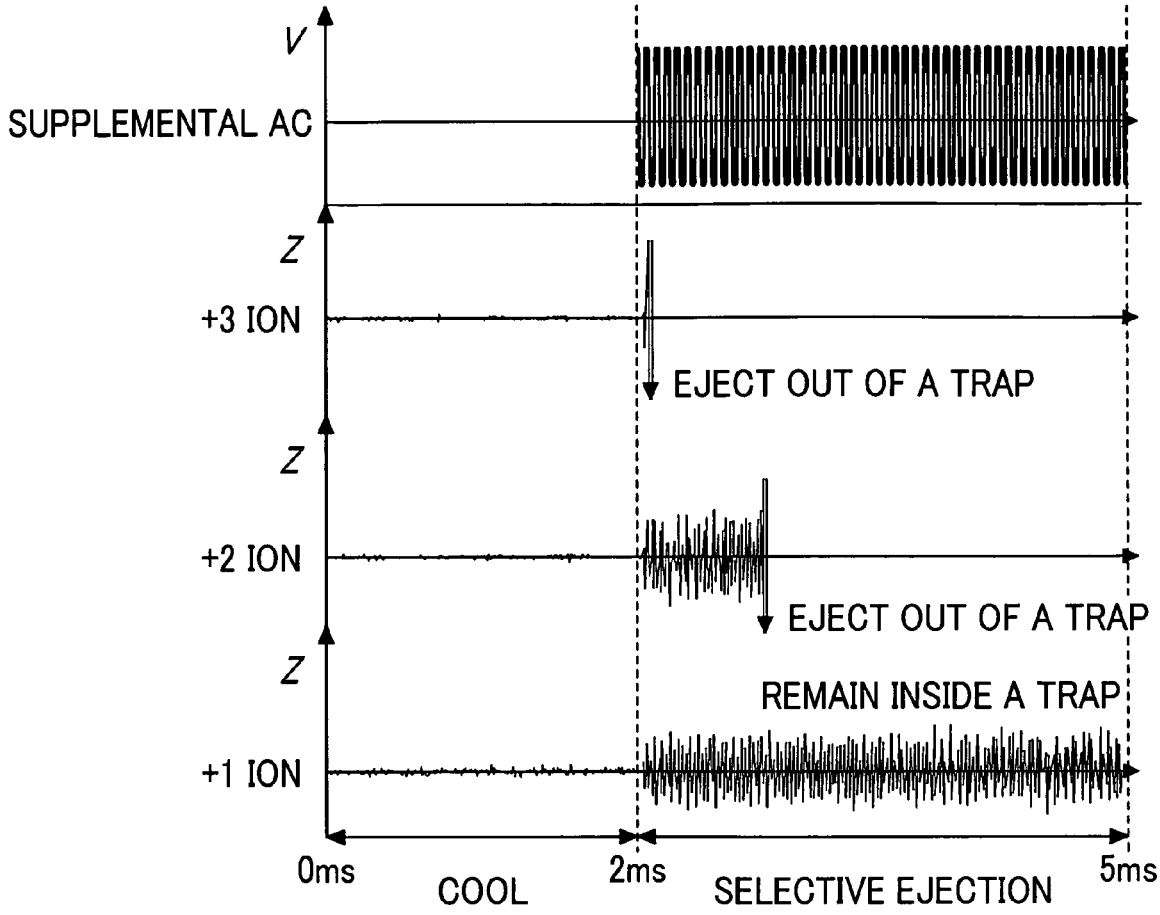
FIG. 3 is a diagram explaining an effect of the mass spectrometer in the first embodiment.

It is assumed that dependency of the collision cross section on a molecular weight is based on the formula (5). FIG. 3 illustrates a result of simulation of three following kinds of ions which have the same mass-to-charge ratio (=molecular weight/charge number) of 600. When D=5 V, ions with a charge of 1 (mass 600 Da, collision cross section 3.38 $nm^2$), ions with a charge of 2 (mass 1200 Da, collision cross section 4.52 $nm^2$), and ions with a charge of 3 (mass 1800 Da, collision cross section 5.35 $nm^2$) were subjected to ion orbit simulation (not shown for accumulation and ejection). First, ions were cooled for 2 ms. Then, a supplemental AC voltage was applied to between end lenses for 3 ms, as described later. More specifically, when the pressure of helium gas is 100 mTorr (13 Pa), the supplemental AC voltage of 40 kHz, and 3.6 V (0-peak) was applied. At this time, the singly charged ions are trapped in the trap, while doubly charged ions and triply charged ions are ejected from the trap. Although not shown in the figure, ions with more than four charges are also ejected in this case. This is because a force for ejecting the ions outside the trap from the supplemental AC field is increased in proportion to the charge thereof. A force for confining ions to the center of the trap by gas collision is increased depending on the mass as described in the formula (6), but not in proportion to the mass. That is, the force is not increased in proportion to an amount of charge. It is supposed that the higher the charge, the relatively larger the force for ejection with respect to the force for pushing back.

Figure 4:
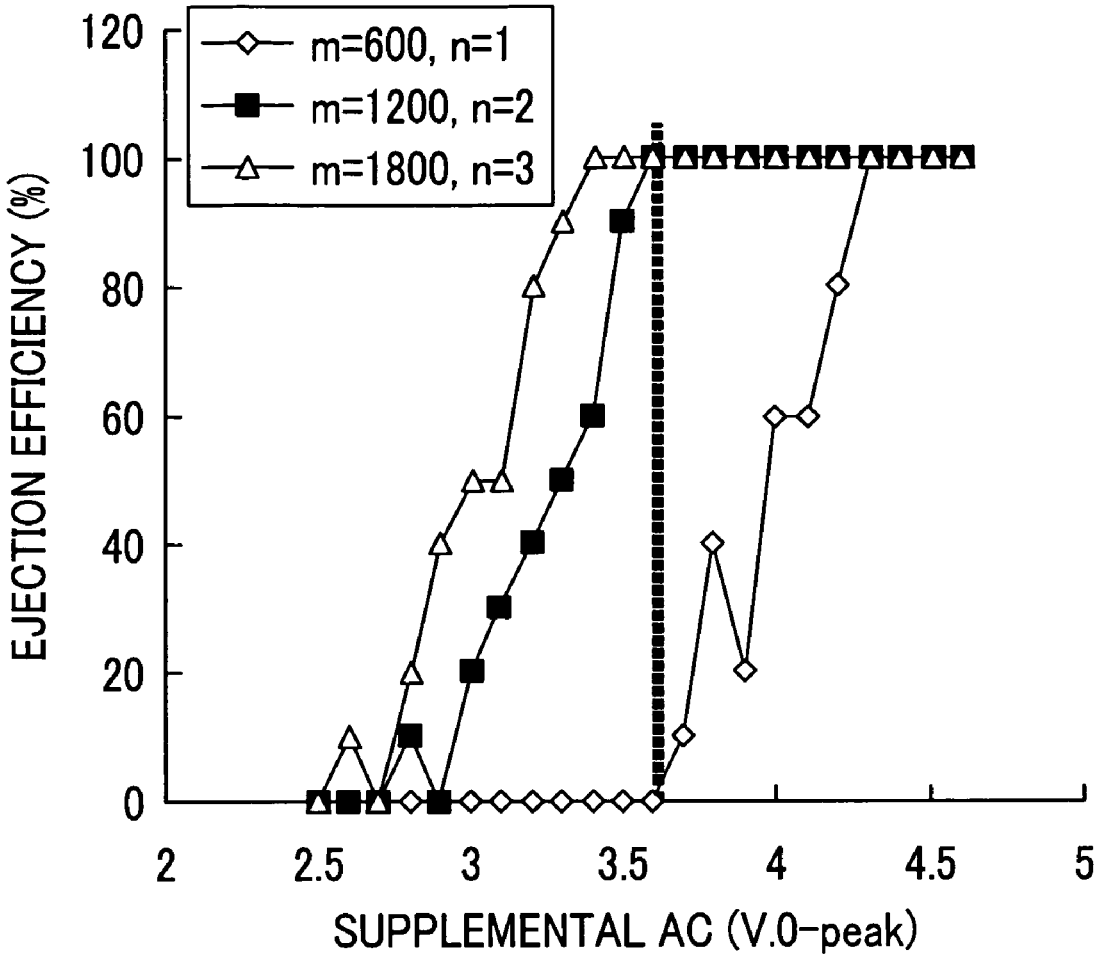
FIG. 4 is a diagram explaining another effect of the mass spectrometer.

FIG. 4 illustrates a result of simulation of an ion ejection efficiency with respect to the supplemental AC voltage in helium gas of 100 mTorr (13 Pa) serving as a bath gas. As shown in the figure, the singly charged ions are completely ejected at the supplemental AC voltage of 4.3 V, while about 100% of the doubly charged ions and the triply charged ions are ejected at the supplemental AC voltages of 3.6 V and 3.4 V, respectively, which are lower than that of the singly charged ion. When the supplemental AC voltage is set to 3.6 V, 100% of the singly charged ions are trapped, while 100% of the doubly charged ions and the triply charged ions can be ejected in an axial direction of the trap.

When a trap potential and a gas pressure are set to respective values, a supplemental AC voltage suitable for the charge separation depends on the mass-to-charge ratio. A supplemental AC voltage gain that retains singly charged ions and ejects multiple charge ions is previously determined for each of several mass numbers by experiment, and is recorded in a gain table 8 within the power supply 7 for the controller. The table may be concerned with information on a relationship between the mass-to-charge ratio and the voltage. As a sample for this experiment, a mixed solution may be used which contains for example, polyethylene polymer, such as polyethylene glycol 500 (hereinafter referred to as PEG 500), PEG1000, and PEG 2000. The solution contains singly charged ions of PEG 500, doubly charged ions of PEG 1000, and quadruply charged ions of PEG 2000 with the mass-to-charge ratio of about 500. A frequency of a supplemental AC voltage used for charge separation of ions with the mass-to-charge ratio m/z of 500 is calculated by the formula (4). An experiment is performed by changing a supplemental AC voltage gain at this frequency, thereby determining a supplemental AC voltage gain for ejecting multiple charged ions with the mass-to-charge ratio of about 500. Singly charged ions of PEG 1000 and doubly charged ions of PEG 2000 with the mass-to-charge ratio m/z of about 1000 exist in the solution. Likewise, an experiment is performed by adjusting the supplemental AC voltage gain based on the frequency determined from the formula (4), thereby determining a voltage gain for ejection of the only multiply charged ions with the mass-to-charge ratio of 1000. Similarly, the frequency and the voltage gain corresponding to each mass-to-charge ratio are stored in the table 8 of the controller power supply 7. In the case of ejecting multiply charged ions with a desired mass-to-charge ratio, a supplemental AC voltage is determined referring to the frequency and the voltage gain stored in the table 8 of the controller power supply 7.

Figure 5:
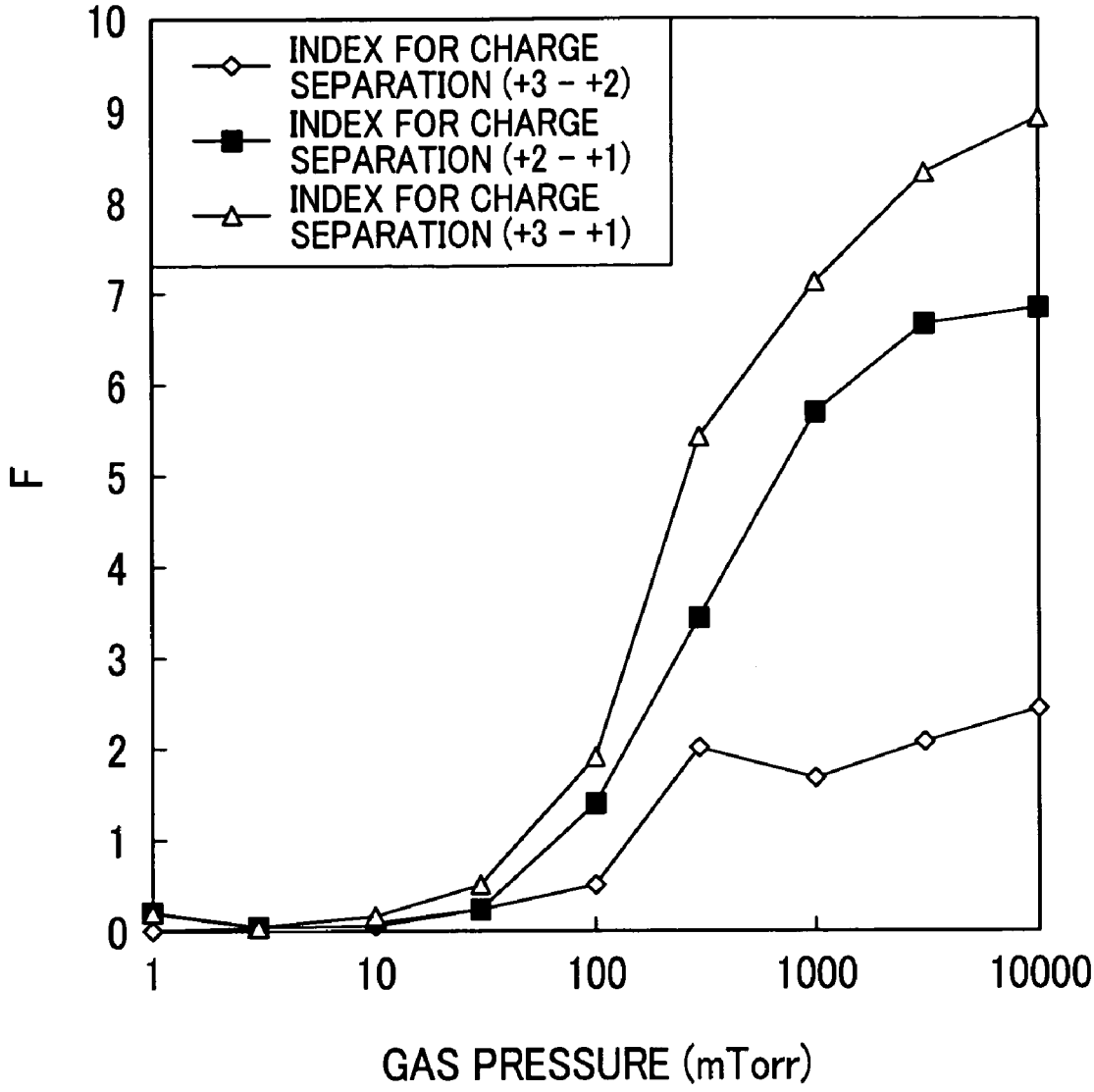
FIG. 5 is a diagram explaining a further effect of the mass spectrometer.

This enables separation of ions with the specific mass-to-charge ratio of 600 based on the charge thereof for a short time of 5 ms, during which the ion separation would be unable in the prior art. A typical accumulation time of 10 ms and a typical charge separation time of 5 ms are substituted into the formula (1) to provide the Duty Cycle of 50%, which is six times more sensitive than that in the prior art, for example, 8%. This is an effect given by high-speed charge separation according to the invention. To quantitatively determine separability of n-charged ions and m-charged ions (m>n), a parameter F represented by the following formula (7) is introduced as an inside for charge separation, $$F_{n\to m} = 2\frac{(V_n - V_m)}{(DV_n + DV_m)}$$

wherein voltages causing ejection of 50% of singly charged ions, doubly charged ions, and triply charged ions are V1, V2, and V3, respectively, and voltage widths in which the amounts of ejection of the singly charged ions, doubly charged ions, and triply charged ions are respectively changed from 10% to 90% are DV1, DV2, and DV3. For example, for F=1, a supplemental AC voltage could be obtained for ejection of 10% of the n-charged ions and 90% of the m-charged ions. This means that the larger the F value, the higher the separability based on the charge. FIG. 5 illustrates the dependency of the separation parameter F on a pressure of helium gas. This type of charge separation is effective particularly at 100 mTorr or more (13 Pa or more).

When a bath gas with high mass, such as nitrogen (molecular weight 28.0), air (average molecular weight 28.8), or Ar (molecular weight 40.0), is used, the same phenomenon can be observed approximately in inverse proportion to the mass under a low pressure (about more than 10 to 15 mTorr, or more than 1.3 to 1.8 Pa). A pressure range useful for the charge separation is different from that used in a normal ion trap or linear trap (for example, 0.02 to 10 mTorr, or 2.6 mPa to 1.3 Pa in helium gas). It should be noted that the reason why the above-mentioned high pressure (for example, 100 mTorr or more, or 13 Pa or more in helium gas) is not selected as the pressure for use in the normal ion trap or linear trap is that the selective resolution based on the mass-to-charge ratio using the supplemental AC voltage is significantly degraded. The object of the invention is to achieve the charge separation, and not the mass-to-charge ratio (molecular weight/electric charge) separation. Such degradation in selective resolution of the mass-to-charge ratio is not problematic. As mentioned above, the use of the bath gas with high mass, such as helium (100 mTorr or more, or 13 Pa or more), nitrogen (molecular weight 28.0), air (average molecular weight 28.8), or Ar (molecular weight 40.0), can generate a gain table 8 containing the frequency and voltage value of the supplemental AC voltage corresponding to the appropriate mass-to-charge ratio at the pressure of 10 to 15 mTorr (1.3 to 1.8 Pa) or more in the same manner as mentioned below. This can eject ions with high charge and trap ions with low charge, thereby permitting the charge separation.

The ions with the high charge number ejected are detected by the mass spectrometry section 6, such as an ion trap, a linear trap, a TOF, or a Fourier transform type ion-cyclotron mass spectrometry section, which is well known. In some cases, the ions ejected may be detected after ion isolation and dissociation processes under the known control of measurement by the mass spectrometry section 6. Note that although in the embodiment four rods are used in the charge separation linear trap, six, eight, or twelve rods may exhibit the same effect as that described above. Also, the ions with low charge accumulated in the trap are capable of being introduced into and detected by the mass spectrometry section 6 by applying a DC electric field to the trap before ejection. When the accumulation time is 10 ms, and the ejection time is 5 ms, the Duty Cycle becomes 50%, which is six times more sensitive than that in the prior art, for example, 8%. This is an effect given by high-speed charge separation according to the invention.

Second Embodiment

In the above-mentioned embodiment, charge separation of ions with the specific range of mass-to-charge ratios is performed using the supplemental AC voltage with a single frequency. In a second preferred embodiment, charge separation of ions with a wide range of mass-to-charge ratios is also allowed. A composite wave with a frequency $f_N$ represented by the following formula (8) (typically 1 to 50 kHz, changed by 0.5 kHz) is used as a supplemental AC voltage.

$$\sum^{N} A_N \sin(2\pi f_N t + \phi_N)$$

In this case, since an appropriate voltage is different depending on the mass-to-charge ratio (frequency), it is necessary to give a voltage gain $A_N$ which differs depending on each frequency component $f_N$. Ions resonate with only the frequency component in the vicinity of the resonance frequency to be ejected into the mass spectrometry section 6. Also in this case, a frequency and a voltage gain $A_N$ of a supplemental AC voltage for ejecting only ions with high charge and retaining ions with low charge into the trap is determined by the same experiment as that in the first embodiment, and stored in the gain table 8 of the controller power supply 7. In charge separation, the controller power supply 7 combines the supplemental AC voltages based on the formula (8) with reference to the gain table 8 containing frequencies and voltages corresponding to a desired range of the mass-to-charge ratios, and applies the combined voltage to the linear trap. When the accumulation time is 10 ms, and the ejection time is 5 ms, the Duty Cycle becomes 50%, which is six times more sensitive than that in the prior art, for example, 8%. This is an effect given by the high-speed charge separation according to the invention.

Third Embodiment

Figure 6:
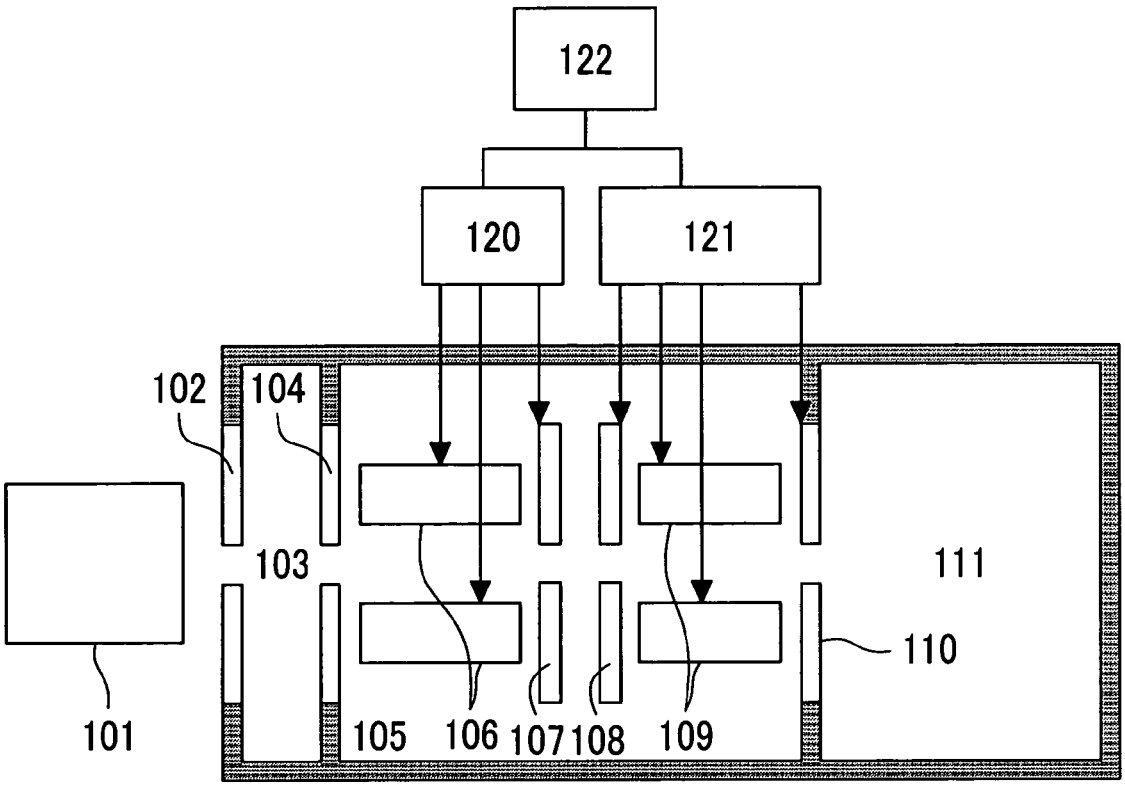
FIG. 6 a diagram showing a mass spectrometer according to a third preferred embodiment.

In the third embodiment, the charge separation trap described in the first embodiment is applied particularly to an ion source and an intermediate section (differential pumping region) of a mass spectrometry section. This application is illustrated in FIG. 6. Ions are generated by an atmospheric pressure ion source 101, such as an electrospray ion source, an atmospheric pressure chemical ion source, an atmospheric pressure light ion source, or an atmospheric pressure matrix assisted laser desorption ion source. The ions generated are introduced into a first differential pumping region 103 via a first porous lens 102. The first differential pumping region is exhausted by a vacuum pump (not shown), and is maintained at 1 to 10 Torr (130 to 1300 Pa, the main component being air) The ions pass through a second porous lens 104 to be introduced into a second differential pumping region 105 where the trap of the invention is disposed. In the second differential pumping region 105, a pressure is kept at 10 mTorr to 1 Torr (1.3 to 130 Pa, the main component being air) by the vacuum pump (not shown). The second differential pumping region 105 is provided with pre-trap sections 106, and 107 for trapping ions, and charge separation trap sections 108, 109, and 110 for performing the charge separation. The pre-trap section is composed of multipole rods 106 and end lenses 107. The RF voltages (500 to 2000 kHz, maximum amplitude 1 kV) in opposite phase are alternately applied to between the multipole rods, thereby radially forming a trap potential.

Figure 7:
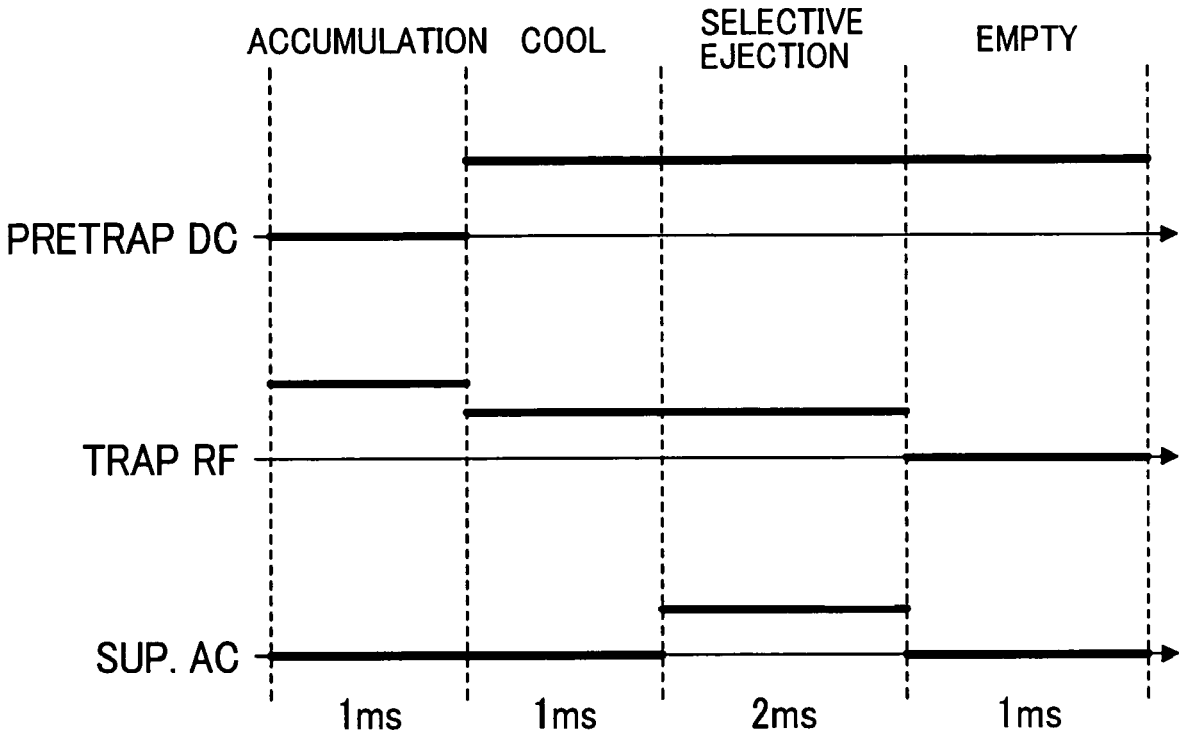
FIG. 7 is a diagram showing a measurement sequence in the third embodiment.

By controlling the DC voltage on end lens 107, a trap potential can be formed axially. This causes ions to be trapped into and ejected from the pre-trap. The charge separation trap is the same as that described in the first embodiment. The pre-trap section and the charge separation trap section are respectively controlled by a pre-trap control power supply 120 and a power supply 121 for the charge separation trap section, which are controlled by a controller 122. FIG. 7 illustrates measurement sequences of the pre-trap section and the charge separation trap section. Each sequence includes four stages, namely, accumulation, cooling, separation and ejection, and empty. In accumulation, a DC voltage of the end lens 107 of the pre-trap is set to be lower than a DC voltage of the rod of the pre-trap. This causes ions pre-trapped or ions introduced from the ion source to be introduced into the charge separation trap. After cooling the ions for about 1 ms, a supplemental AC voltage is applied to perform charge separation. At this time, ions with high charge pass through the end lenses 110 into a mass spectrometry chamber 111. The mass spectrometry chamber 111 is exhausted by a vacuum pump, and is maintained at $10^{-4}$ Torr (0.013 Pa) or less. The ions ejected can be detected by various mass spectrometers, including an ion trap, a linear trap, and a TOF, which may be disposed in the mass spectrometry chamber.

The ions may be detected after separation and dissociation. The ions with low charge retained in the charge separation trap after ejecting the other ions can be ejected outside the trap by changing the RF voltage to zero. Thereafter, by repeating the above-mentioned operation, multiply charged ions are selectively introduced into the mass spectrometry section. This enables speedy measurement thereby to significantly reduce a decrease in duty cycle due to the charge separation. In the third embodiment, in ion ejection and charge separation, ions introduced from the ion source are trapped in the pre-trap section, and thus the relationship represented by the formula (1) is not satisfied. The ions pre-trapped are introduced into the linear trap in accumulation, resulting in a duty cycle of 100%, which is twelve times more sensitive than that in the prior art, for example, 8%. This is an effect given by high-speed charge separation according to the invention.

It should be noted that in all embodiments described, the effect of the invention may also be produced by any other appropriate ion traps (for example, such as those disclosed in the patent documents described, namely, the U.S. Pat. Nos. 5,420,425, 6,177,668, and 5,783,824), which have the features of the invention, in addition to the linear traps having the structure embodied in the embodiments. That is, the effect of the invention can be applied to any ion trap systems in general, in which a substantially harmonic potential is formed in the DC or AC voltage axially or radially, and a supplemental AC voltage resonating with a resonance frequency of ions is applied within the potential, so that an orbit amplitude of ions with high charge becomes selectively larger than that of ions with low charge, thereby performing the charge separation. A secondary effect provided by the invention is that only the ions of a specific charge are selectively permeable, leading to reduction in space charge effect in the mass spectrometry section in the later stage.

Fourth Embodiment

Although in the embodiments described above, only the charge separation is explained, separation based on ion mobility using the similar principle may be performed in the invention. It is known that, when an electric field is applied under a gas pressure of 1 mTorr or more, ions moves at a velocity equivalent to the gas collision effects. Ion mobility is used as a parameter representing ion velocity/electric field at this time. For example, for ions with the same mass number, the larger the size of an ion, the lower the ion mobility of the ion becomes due to high collision frequencies. When ion mobility of a first group of ions is lower than that of a second group of ions, the velocity of the first group of ions accelerated is lower than that of the second group of ions even in the same electric field. In an ion trap for ejecting ions having a velocity equal to or more than a specific velocity, ions having a specific shape can be separated.

Figure 8:
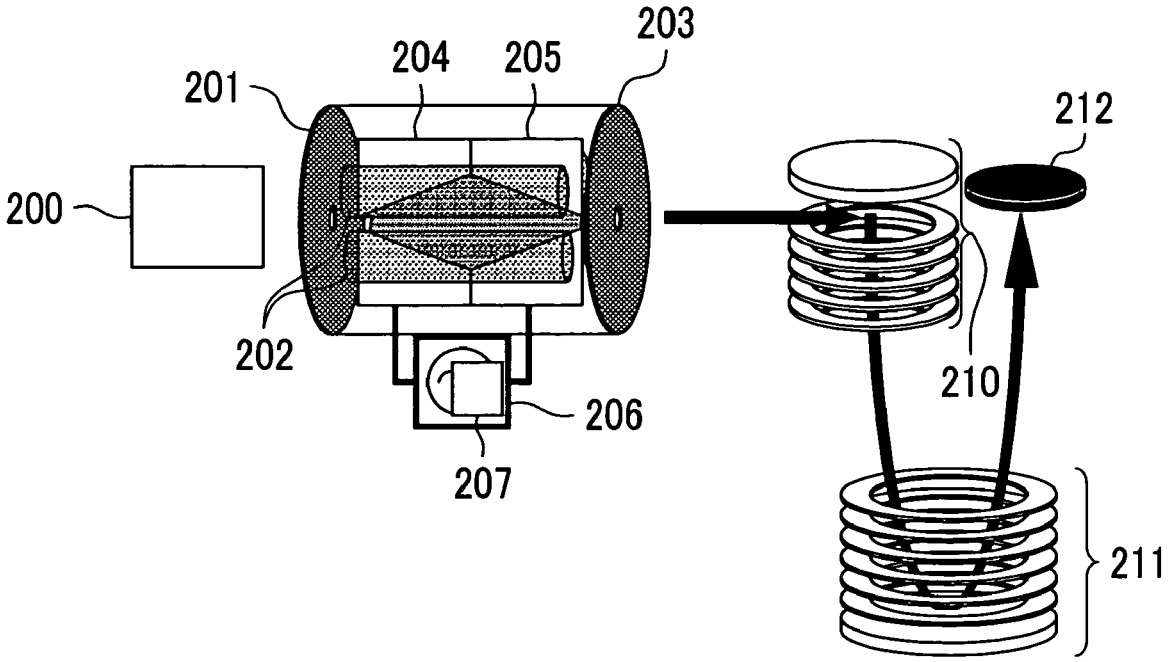
FIG. 8 a diagram showing a mass spectrometer according to a fourth preferred embodiment.

FIG. 8 illustrates an example of an apparatus for performing ion mobility separation. Ions generated in an ion source 200 pass through an ion transport section, including an ion guide, and an ion trap, and then through an inlet end lens 201 in a bath gas, to be introduced into the ion trap. The ion trap consists of wing electrodes 204, and 205, each serving as an insertion electrode, and multipole rods 202. A DC electric field is applied to between the wing electrodes 204, 205 and an offset potential of the multipole rods 202 to form a harmonic type potential axially. The application of a supplemental AC voltage with a specified frequency between the wing electrodes causes ions with the specific mass number to resonate axially and to be ejected from the end lenses 203.

The ions ejected are accelerated orthogonally by an accelerator 210, reflected by a reflectron 211, and then detected by a detector 212, thereby obtaining a mass number spectrum from a time of flight. It is pointed out that in the known ion trap, ions with the specific mass-to-charge ratio are ejected by changing a frequency. In the invention, however, a condition exists in which only ions with high ion mobility are ejected, and only ions with low ion mobility are trapped.

When the trap potential and gas pressure are set to predetermined respective levels, a supplemental AC voltage appropriate for the ion mobility separation depends on the mass-to-charge ratio. A supplemental AC voltage gain that retains ion species with specific ion mobility and ejects ion species with ion mobility larger than the above one is previously determined for each of several mass-to-charge ratios by experiment, and is recorded in a gain table 207 within a power supply 206 for a wing electrode controller. The table may be information on a relationship between the mass-to-charge ratio and the voltage. The frequency of the supplemental AC voltage used for charge separation of a mass-to-charge ratio m/z of 500 is calculated by the formula (4). An experiment is performed by changing the supplemental AC voltage gain of this frequency, thereby determining a supplemental AC voltage gain for ejection of the only ions with the mass-to-charge ratio m/z of about 500, and with ion mobility larger than the specific mobility. Likewise, for the mass-to-charge ratio m/z of about 1000, an experiment is performed by adjusting the supplemental AC voltage gain based on the frequency determined by the formula (4), thereby determining a voltage gain for ejection of the only ions with the mass-to-charge ratio of about 1000, and having ion mobility larger than the specific mobility. Similarly, the frequency and the voltage gain corresponding to each mass-to-charge ratio are stored in the table 207 of the controller power supply 206. In the case of ejecting the ions with a desired mass-to-charge ratio and having the specific ion mobility, a supplemental AC voltage is determined referring to the frequency and the voltage gain stored in the table 207 of the controller power supply 206. When ion mobility of interest is unclear, any plurality of gains may be introduced, in addition to formation of the above-mentioned table containing the frequencies and gains.

Although ion mobility separation is applicable even in the described structure shown in FIG. 1, the linear trap as shown in FIG. 1 has a strong influence of an RF electric field on the end lenses 1 and 3. In contrast, a linear trap as shown in FIG. 8 almost never has any influence of an RF electric field on nearby end lenses. Thus, the separability or resolution of the ion mobility in the ion trap shown in FIG. 8 is higher than that in the ion trap shown in FIG. 1. Also, the ion trap of FIG. 8 has enough resolution even under a lower gas pressure (for example, at 1 mTorr or more, or 0.13 Pa or more of gas including nitrogen, Ar, and air, alternatively, at 10 mTorr or more, or 1.3 Pa or more of helium), as compared to the linear trap of the first embodiment. Since the potential in the axial direction can be formed individually by the wing electrodes as will be described later, the ion trap of FIG. 8 has a higher degree of flexibility in the axial length, so that the length of a potential area can be set to 10 to 100 mm (typically, about 50 mm).

Figure 9A:
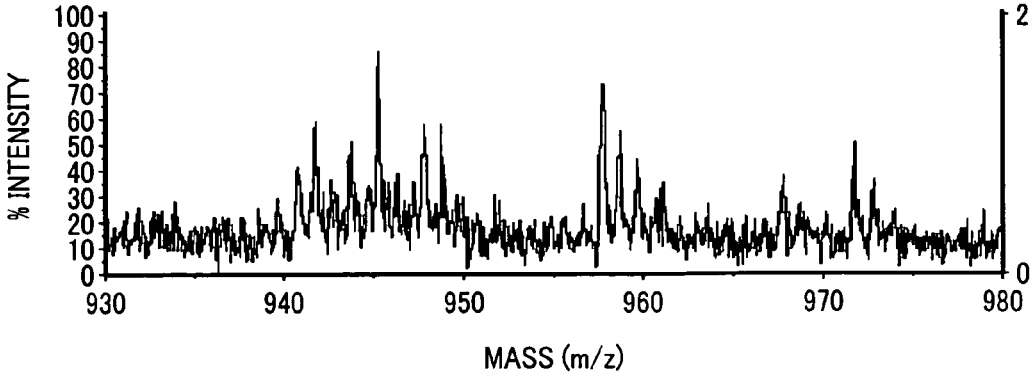
FIG. 9 is a diagram explaining an effect of the mass spectrometer in the fourth embodiment.
Figure 9B:
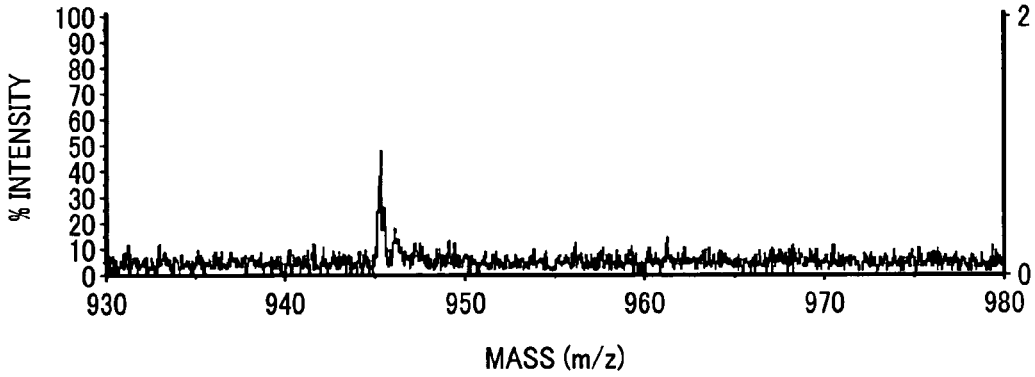

Reference will now be made to effects in the embodiment using FIG. 9. Scanning is performed in the trap at frequencies from 4 kHz to 15 kHz with a depth of a harmonic potential of 5 V, and with an axial length of 50 mm. A bath gas is helium with its pressure set to 10 mTorr. FIG. 9A shows a mass spectrum when the supplemental AC voltage is 0.85 V, and FIG. 9B shows a mass spectrum of ions when all ions are ejected by application of DC potentials to both ends of the trap. A sample used contains a mixture of perfluoroalkylphosphazine (Ultramark 1621) and PEG. In ejection of all ions (FIG. 9A), the spectrum shows peaks due to the PEG and the Ultramark 1621 (at m/z=944). In contrast, the spectrum shows that at a supplemental AC voltage of 0.85 V (FIG. 9B), only a peak due to the Ultramark 1621 (with a m/z=944) appears preferentially. It is known that the Ultramark 1621 has a spherical structure, and has a small collision cross section, and large ion mobility, as compared to the PEG. The result of FIG. 9 shows that only ions with large ion mobility can be preferentially ejected by appropriately setting the supplementary AC voltage in the embodiment.

Figure 10:
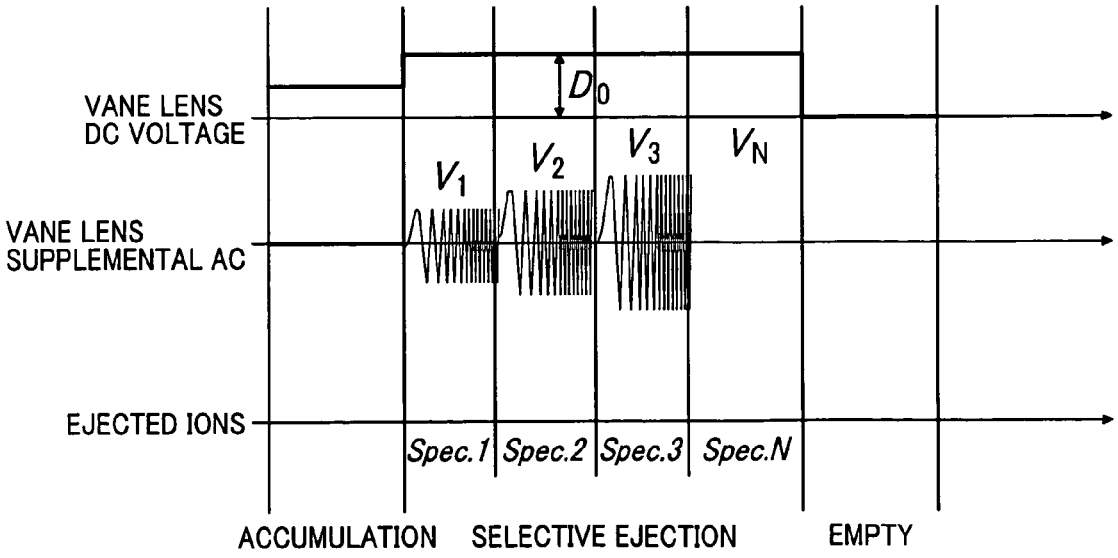
FIG. 10 is a diagram showing a measurement sequence in the fourth embodiment.

A two-dimensional spectrum (first dimension: ion mobility, second dimension: mass number) can be obtained by changing a measurement supplementary AC voltage to 0.85 V, 0.90 V, 0.95 V, . . . 1.50 V sequentially as shown in FIG. 10. It is well known that the degree of ion mobility is dependent on a molecular species. Thus, the supplemental AC voltage can be adjusted and set to an appropriate value by scanning the frequency, thereby selectively ejecting only molecular species with a specific shape (for example, an annular shape, a linear shape, or the like). In this case, although the supplemental AC voltage is set to a constant value when scanning of frequencies as shown in FIG. 10, only the specific ion species can be ejected by appropriately changing the voltage.

Figure 11A:
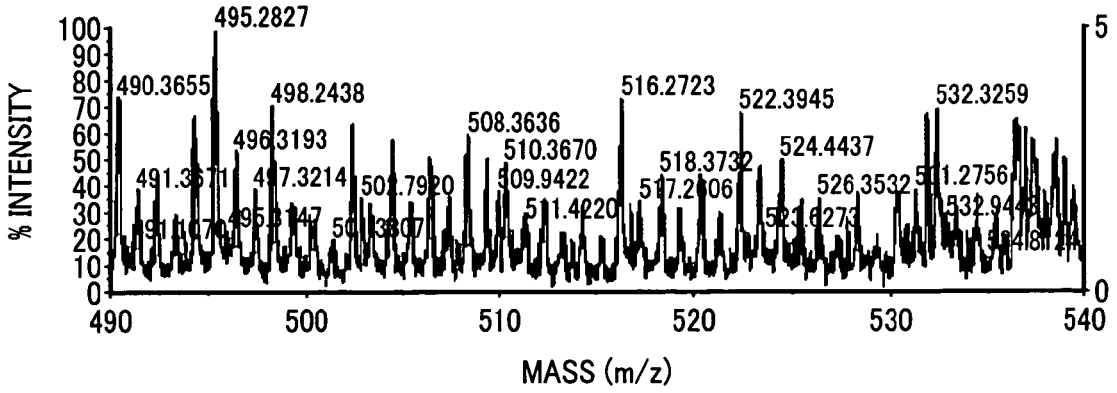
FIG. 11 is a diagram explaining an effect of the mass spectrometer in the fourth embodiment.
Figure 11B:
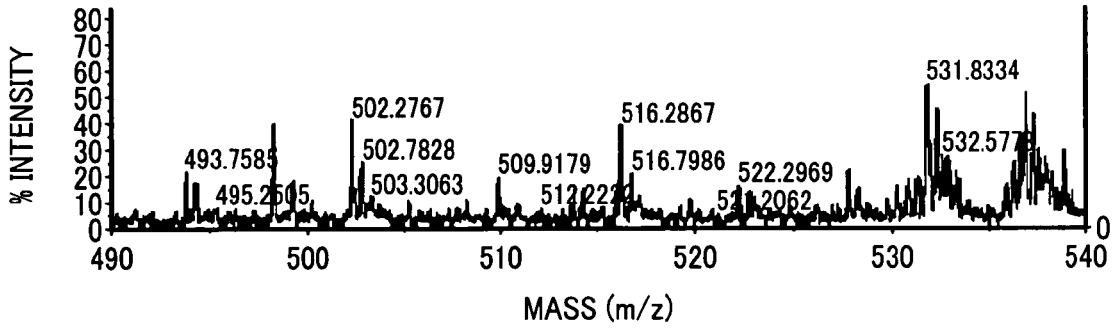

Also, in the apparatus as shown in FIG. 8, charge separation can be done in another embodiment, which is illustrated in FIG. 11. As a sample, a peptide mixture containing twenty kinds of peptides (at a concentration of 1 to 100 nM) was used, and helium with a pressure of 10 mTorr was used as gas for an experiment. FIG. 11A illustrates a mass spectrum obtained when all ions in the trap are ejected by setting the supplemental AC voltage to 1.5 V. It shows that chemical noise due to the singly charged ions occurs every 1 Th, and no peak due to the multiply charged ions can be detected. In contrast, FIG. 11B illustrates a mass spectrum obtained when the supplemental AC voltage is set to 0.80 V. FIG. 11B shows that only peaks due to a plurality of multiply charged ions are selectively detected. As mentioned above, the present embodiment is effective in separation based on the ion mobility due to molecular shapes, and separation between the multiply charged ions and the singly charged ions. In general, it is known that the multiply charged ion has lower ion mobility than that of the singly charged ion. The charge separation in the first to third embodiments is one of examples of the ion mobility separation.

Although in FIG. 8, mass spectrometric analysis is performed by a time-of-flight mass spectrometer after trapping for the ion mobility separation, mass spectrometric analysis may be carried out by the ion trap mass spectrometer, or the Fourier transform mass spectrometer. As mentioned above, since the trap for the ion mobility separation has a capability of mass separation, a mass spectrum can be obtained by simply providing a detector. In this case, although the trap has the mass resolution that is inferior to that of the other mass spectrometer, it has an advantage in cost.

What is claimed is:

1. A mass spectrometer comprising:

an ion source;

an ion trap section for trapping ions ionized by said ion source;

an ion trap controller for controlling a voltage on an electrode included in said ion trap section; and a detector for detecting the ions ejected from said ion trap section, wherein said ion trap controller includes a table for each mass-to-charge ratio, the table containing a frequency of the voltage used for charge separation, and a gain of said voltage for ejecting a first ion with a first charge outside the ion trap section, and retaining in the ion trap section a second group of ions with a second charge that is lower than the first charge, and wherein the ion trap controller controls the voltage based on the mass-to-charge ratio set.

2. The mass spectrometer according to claim 1, wherein said table is a table regarding the frequency and the gain for each range of the mass-to-charge ratios, and said controller controls the voltage based on the range of the mass-to-charge ratios set.

3. The mass spectrometer according to claim 1, further comprising a pre-trap section for trapping the ions in between the ion source and the ion trap section, and a pre-trap controller for controlling a voltage on an electrode included in the pre-trap.

4. The mass spectrometer according to claim 1, wherein said ion trap section includes a plurality of multipole rods, and end lenses sandwiching said plurality of multipole rods therebetween.

5. The mass spectrometer according to claim 1, wherein a bath gas in the ion trap section is helium with a pressure of 10 mTorr (1.3 Pa) or more.

6. The mass spectrometer according to claim 1, wherein a bath gas in the ion trap section is at least one of nitrogen, oxygen, and argon, with a pressure of 1 mTorr (0.13 Pa) or more.

7. The mass spectrometer according to claim 1, wherein said table is generated based on at least one of a kind of gas in the ion trap section, a pressure of the gas, and a trap potential.

8. A mass analysis method comprising the steps of:

ionizing a sample;

introducing ions ionized into an ion trap section;

applying a voltage to an electrode included in the ion trap section, the voltage having a frequency based on a mass-to-charge ratio set, and a gain for the set mass-to-charge ratio for ejecting a first ion with a first charge outside the ion trap section, while retaining in the ion trap section a second ion with a second charge that is lower than the first charge; and detecting the first ion ejected.

9. The mass analysis method according to claim 8, further comprising the step of decomposing and dissociating the first ion ejected.

10. The mass analysis method according to claim 8, further comprising the steps of introducing the ionized ions into a pre-trap section, and applying a voltage having a frequency based on the mass-to-charge ratio set to an electrode included in said pre-trap section, thereby introducing the ions with the mass-to-charge ratio set into the ion trap section.

11. A mass spectrometer comprising:

an ion source;

an ion trap section for trapping ions ionized by said ion source;

an ion trap controller for controlling a voltage on an electrode included in said ion trap section; and a detector for detecting the ions ejected from said ion trap section, wherein said ion trap controller includes a table for each mass-to-charge ratio, the table containing a frequency of the voltage used for ion mobility separation, and a gain of said voltage for ejecting a first group of ions with first ion mobility outside the ion trap section, and retaining in the ion trap a second group of ions with second ion mobility that is lower than the first ion mobility, and wherein the ion trap controller controls the gain or the frequency of the voltage based on the mass-to-charge ratio set.

12. The mass spectrometer according to claim 11, wherein said ion trap section includes a plurality of multipole rods, and end lenses sandwiching said plurality of multipole rods therebetween.

13. The mass spectrometer according to claim 11, wherein said ion trap section includes a plurality of multipole rods, end lenses sandwiching said plurality of multipole rods therebetween, and an insertion electrode inserted into between the multipole rods.

14. The mass spectrometer according to claim 12, wherein said ion trap controller controls the voltage such that a harmonic potential is formed by a DC electric field on a rod axis.

* * * * *